US009224295B2

(12) United States Patent
Saloner et al.

(10) Patent No.: US 9,224,295 B2
(45) Date of Patent: Dec. 29, 2015

(54) AUTOMATED SYSTEM FOR PREVENTING VEHICLE BUNCHING

(71) Applicant: Via Analytics, Inc., Berkeley, CA (US)

(72) Inventors: Dylan Saloner, Palo Alto, CA (US); Yiguang Xuan, Berkeley, CA (US); Juan Argote, Berkeley, CA (US); Carlos Daganzo, Berkeley, CA (US)

(73) Assignee: Via Analytics, Inc., Berkeley, CA (US)

( * ) Notice: Subject to any disclaimer, the term of this patent is extended or adjusted under 35 U.S.C. 154(b) by 0 days.

(21) Appl. No.: 14/367,873

(22) PCT Filed: Dec. 20, 2012

(86) PCT No.: PCT/US2012/071050

§ 371 (c)(1),
(2) Date: Jun. 20, 2014

(87) PCT Pub. No.: WO2013/096675

PCT Pub. Date: Jun. 27, 2013

(65) Prior Publication Data

US 2015/0046073 A1 Feb. 12, 2015

Related U.S. Application Data

(60) Provisional application No. 61/578,179, filed on Dec. 20, 2011.

(51) Int. Cl.
*G08G 1/00* (2006.01)
*G08G 1/123* (2006.01)
(Continued)

(52) U.S. Cl.
CPC .... *G08G 1/096716* (2013.01); *G08G 1/096741* (2013.01); *G08G 1/096775* (2013.01); *G08G 1/096791* (2013.01); *G08G 1/127* (2013.01); *G08G 1/133* (2013.01)

(58) Field of Classification Search
USPC ..... 701/117; 340/994
See application file for complete search history.

(56) References Cited

U.S. PATENT DOCUMENTS 5,390,120 A 2/1995 Caron et al.
5,739,774 A * 4/1998 Olandesi ..... 340/994
(Continued)

OTHER PUBLICATIONS

International Search Report and Written Opinion mailed Mar. 22, 2013, for International Application No. PCT/US2012/71050, filed Dec. 20, 2012, 9 pp.
(Continued)

*Primary Examiner* — Thomas G Black
*Assistant Examiner* — Tyler Paige
(74) *Attorney, Agent, or Firm* — Perkins Coie LLP

(57) ABSTRACT

The present invention contemplates a distributed automatic control system for preventing the vehicle bunching. Information of vehicle locations is automatically detected and used to determine the positions and velocities of vehicles along a route. Vehicles pass predetermined points, such as stations, along the route. Information about whether the vehicle skipped the station, arrived at the station, or departed from the station, is automatically calculated based on the position and velocity information. This information is distributed among the vehicles that belong to the same route. An in-vehicle controller dynamically calculates holding times at each station and displays the information to the driver so that buses do not get too close to one another, thereby preventing bunching while maintaining appropriate speeds of the vehicles.

15 Claims, 8 Drawing Sheets

(51) Int. Cl.

| | |
|---|---|
| ***G08G 1/0967*** | (2006.01) |
| ***G08G 1/127*** | (2006.01) |
| ***G08G 1/133*** | (2006.01) |

(56) References Cited

U.S. PATENT DOCUMENTS

| | | | | |
|---|---|---|---|---|
| 5,799,263 | A * | 8/1998 | Culbertson | 701/117 |
| 5,808,565 | A | 9/1998 | Matta et al. | |
| 5,948,040 | A * | 9/1999 | DeLorme et al. | 701/426 |
| 6,006,159 | A * | 12/1999 | Schmier et al. | 701/465 |
| 6,374,176 | B1 | 4/2002 | Schmier et al. | |
| 6,405,112 | B1 | 6/2002 | Rayner | |
| 6,437,743 | B1 * | 8/2002 | Mintz et al. | 342/463 |
| 6,700,506 | B1 | 3/2004 | Winkler et al. | |
| 6,791,471 | B2 * | 9/2004 | Wehner et al. | 340/903 |
| 6,816,452 | B1 * | 11/2004 | Maehata | 370/208 |
| 6,965,829 | B2 | 11/2005 | Yamadaji et al. | |
| 7,188,025 | B2 * | 3/2007 | Hudson, Jr. | 701/117 |
| 7,352,743 | B2 * | 4/2008 | Hameleers et al. | 370/389 |
| 7,999,701 | B1 * | 8/2011 | Xu et al. | 340/994 |
| 2002/0153776 | A1 * | 10/2002 | Elliott et al. | 307/38 |
| 2005/0137754 | A1 * | 6/2005 | Bartlett | 701/1 |
| 2005/0137781 | A1 * | 6/2005 | Hudson | 701/117 |
| 2007/0008174 | A1 * | 1/2007 | Schwartz | 340/902 |
| 2008/0012733 | A1 | 1/2008 | Bermudez | |
| 2008/0054072 | A1 * | 3/2008 | Katragadda et al. | 235/384 |
| 2008/0059050 | A1 * | 3/2008 | Lin et al. | 701/117 |
| 2008/0088480 | A1 * | 4/2008 | Rozum et al. | 340/933 |
| 2010/0076670 | A1 * | 3/2010 | Turner et al. | 701/117 |
| 2010/0093272 | A1 * | 4/2010 | Burns | 455/3.06 |
| 2010/0169803 | A1 * | 7/2010 | Mazzei et al. | 715/760 |
| 2010/0197325 | A1 * | 8/2010 | Dredge | 455/456.3 |
| 2011/0095908 | A1 * | 4/2011 | Nadeem et al. | 340/905 |
| 2011/0148623 | A1 * | 6/2011 | Bishop et al. | 340/539.13 |
| 2011/0224893 | A1 * | 9/2011 | Scofield et al. | 701/119 |
| 2012/0326890 | A1 * | 12/2012 | Cross | 340/906 |
| 2014/0136658 | A1 * | 5/2014 | Wahler | 709/218 |
| 2014/0197967 | A1 * | 7/2014 | Modica et al. | 340/932 |

OTHER PUBLICATIONS

Extended European Search Report mailed Jul. 16, 2015, for European Patent Application No. 12860778.5, filed Dec. 20, 2012.

* cited by examiner

AUTOMATED SYSTEM FOR PREVENTING VEHICLE BUNCHING

CROSS-REFERENCE TO RELATED APPLICATION

This application is the National Stage of International Application No. PCT/US2012/071050, filed on Dec. 20, 2012, which claims the benefit of U.S. Provisional Patent Application No. 61/578,179, entitled "AUTOMATED SYSTEM FOR PREVENTING VEHICLE BUNCHING," and filed on Dec. 20, 2011, which are all hereby incorporated by reference in their entireties.

TECHNICAL FIELD

At least one embodiment of the present invention pertains to a distributed automatic control system for preventing bus bunching and promoting schedule adherence in transit systems.

BACKGROUND

Bus bunching (also referred to as clumping, clustering, or platooning) describes the tendency of buses along a particular transit route to pair or bunch together despite being scheduled to appear at constant intervals. If buses are scheduled to run a certain headway time apart, passengers arriving to a station should not expect to wait more than the headway time for the next bus to arrive. If passengers arrive at a random time, the average waiting time is a half of the headway time. If two buses pair, passengers may wait as long as two headways. If more than two buses bunch up, the wait can be even longer.

These unfavorable outcomes are familiar to regular bus riders. Studies of bus systems reveal that they are prone to instability and bunching. This is at least partially due to the undesired feedback loop between bus headways and the time it takes to load passengers at each station. If a bus falls behind schedule, more passengers tend to accumulate than if it were running the scheduled time ahead of it. Increased passenger accumulation requires the laggard bus to wait even longer at each station, further retarding its progress. Conversely, buses ahead of schedule tend to pick up fewer passengers and can go even further ahead of schedule. The result is bus bunching.

Bus bunching or clustering is discussed in several references, such as U.S. Pat. No. 3,772,691, U.S. Pat. No. 5,739,774, U.S. Pat. No. 6,006,159, U.S. Pat. No. 6,374,176 and US Patent Publication 2010/0299177, all of which are incorporated herein by reference in their entireties.

Conventional ways to control bus bunching involve the insertion of a fixed slack time into the schedule at certain points along the route. This slack artificially delays buses and the passengers on board. This conventional technique has limited effectiveness in reducing bus bunching, while bus operators must use more buses to cover the same route, adding operating cost. Furthermore, passengers in the transit must wait longer at each station as the slack time is absorbed. The slack technique is not adaptive to severe disruptions in which the amount of slack is insufficient and thus bunching can still occur.

SUMMARY

Techniques introduced here provide a distributed automatic control system for preventing the vehicle bunching. Information of vehicle locations is automatically detected and used to determine the positions and velocities of vehicles along a route. Vehicles pass predetermined points, such as stations, along the route. Information about whether the vehicle skipped the station, arrived at the station, or departed from the station, is automatically calculated based on the position and velocity information. This information is distributed among the vehicles that belong to the same route. An in-vehicle controller dynamically calculates holding times at each station and displays the information to the driver so that buses do not get too close to one another, thereby preventing bunching while maintaining appropriate speeds of the vehicles.

According to one embodiment, a distributed transportation control system for vehicles of a transportation route is disclosed herein. The system includes a plurality of in-vehicle controllers. Each in-vehicle controller is placed in one of the vehicles of the transportation route. Each in-vehicle controller includes a network interface, a spatial positioning device, a signaling device and a processor. The network interface is configured to exchange status data of the vehicles, with other in-vehicle controllers of the plurality of in-vehicle controllers. The spatial positioning device is configured to continuously collect status data of a individual vehicle in which that in-vehicle controller is placed. The signaling device is configured to provide an operating instruction to an operator of the individual vehicle in which that in-vehicle controller is placed. The processor is configured to determine the operating instruction based on the status data of the vehicles.

According to another embodiment, a method for scheduling a vehicle of a transportation route is disclosed herein. The method includes steps of receiving status data of other vehicles of the transportation route, via a network from other in-vehicle controllers placed in the other vehicles; detecting status data of the vehicle; determining an operating instruction based on the status data of the other vehicles and the status data of the vehicle; and presenting the operating instruction to an operator of the vehicle.

Other aspects of the technology introduced here will be apparent from the accompanying figures and from the detailed description which follows.

BRIEF DESCRIPTION OF THE DRAWINGS

These and other objects, features and characteristics of the present invention will become more apparent to those skilled in the art from a study of the following detailed description in conjunction with the appended claims and drawings, all of which form a part of this specification. In the drawings:

DETAILED DESCRIPTION

References in this specification to "an embodiment," "one embodiment," or the like, mean that the particular feature, structure, or characteristic being described is included in at least one embodiment of the present invention. Occurrences of such phrases in this specification do not all necessarily refer to the same embodiment, however.

Figure 1:
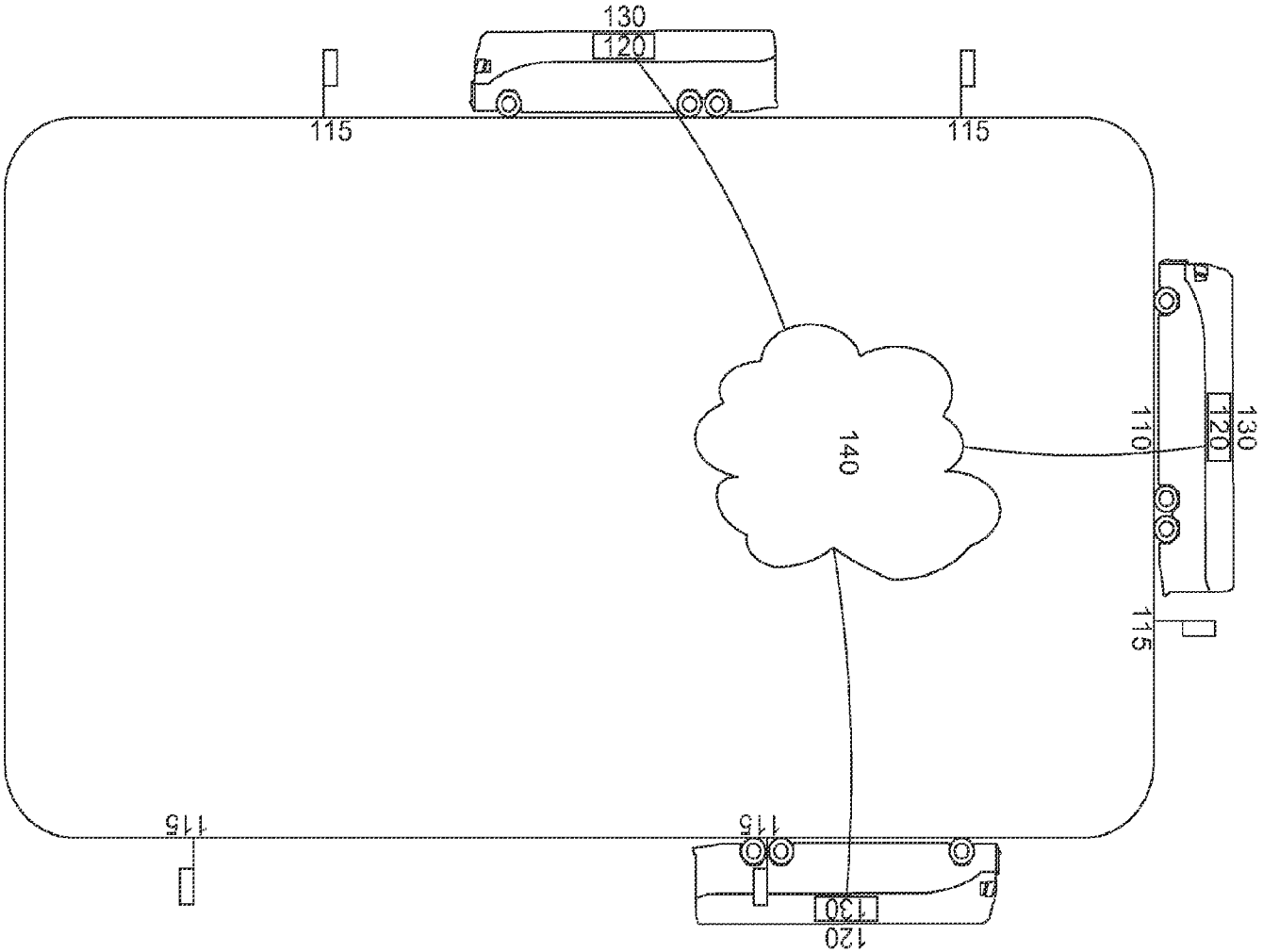
FIG. 1 illustrates an example of a transportation route having multiple buses utilizing a distributed transportation control system.

FIG. 1 illustrates an example of a transportation route having multiple buses utilizing a distributed transportation control system. As showed in the FIG. 1, there are three buses 130 running along a transportation route 110. Buses are scheduled to stop at a plurality of bus stations 115 along the transportation route 110. The distributed transportation control system includes a plurality of in-vehicle controllers 120. Each bus 130 has one in-vehicle controller 120 placed inside of the bus. The in-vehicle controllers 120 collect status data of the buses 130. The in-vehicle controllers 120 exchange status data via a network 140. The network 140 can include a WiFi network, a mobile phone network, a satellite network, a wireless data network, the Internet, or any combinations thereof. The techniques disclosed herein can be used in any type of vehicles for transportation, such as buses, taxis, automobiles, trains, aircrafts, motorcycles, bicycles, planes, boats, ships, or spaceships.

Figure 2:
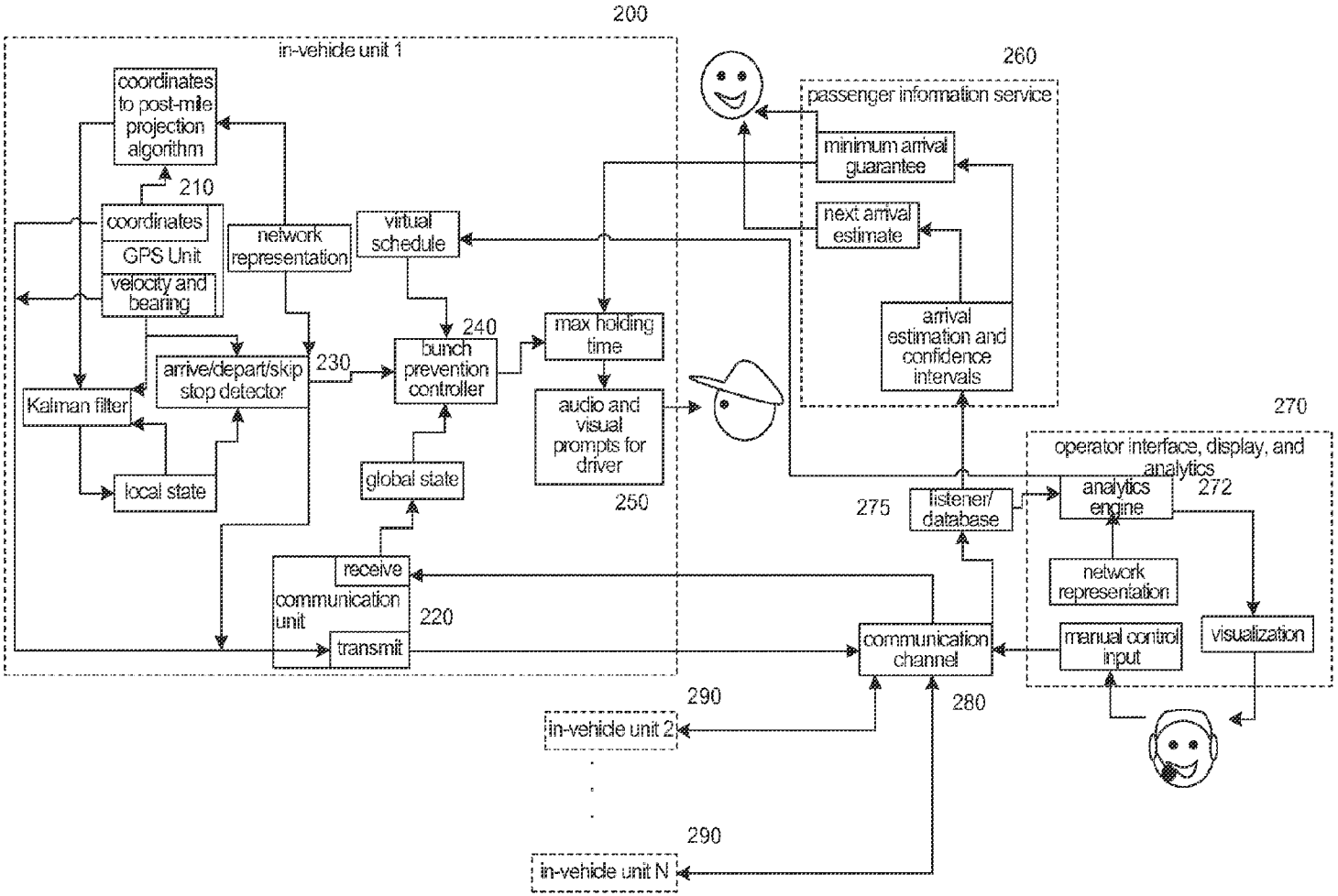
FIG. 2 illustrates an example of an in-vehicle controller of a distributed transportation control system for preventing the vehicle bunching.

FIG. 2 illustrates an example of an in-vehicle controller of a distributed transportation control system for preventing the vehicle bunching. The control system solves the scheduling problems incurred by both users and operators of transit systems. Information of vehicle locations is automatically detected and used to determine the positions and velocities of vehicles along a route. Vehicles pass predetermined points, such as stations, along the route. Information about whether the vehicle skipped the station, arrived at the station, or departed from the station, is automatically calculated based on the position and velocity information.

As shown in the FIG. 2, the in-vehicle controller 200 (also referred to as in-vehicle unit) includes a GPS (Global Positioning System) unit 210. While in operation, the GPS unit 210 continuously collects the location coordinates of the GPS unit 210, which is also the location coordinates of the bus in which the in-vehicle controller 200 is placed. The GPS unit 210 can further generate velocity data of the bus. The GPS unit 210 transmits the location and velocity data to a network interface 220 (also referred to as communication unit). Using the location and velocity data, the in-vehicle controller 200 can further detect status of bus using a detector 230. For example, comparing the location and velocity data of the bus with the locations of the stations of the route, the detector 230 can determine a status value indicating whether the bus is during station arrival, station departure, or station skipping. The status value can also be transmitted to the network interface 220. In one embodiment, the location information of the vehicles may be collected from satellite navigation devices, such as GPS devices, or other types of spatial positioning devices.

The network interface 220 transmits these data to other in-vehicle controllers 290 via a network channel 280. The network interface 220 also receives status data of other buses from the other in-vehicle controllers 290 via the network channel 280. The network interface 220 forward these received status data to a bunch prevention controller 240.

The bunch prevention controller 240 generates an operation instruction to an operator of the bus, based on the received status data of other buses as well as the status data of the bus. In one embodiment, the operation instruction includes a holding time, which is a time period for which the operator is to hold the bus at a station. In another embodiment, the operation instruction includes a visual indication of an extent of the bus being ahead of or behind a schedule. The operating instruction may further include an audio signal to prompt the operator to move the individual vehicle.

In some embodiments, the detector 230 and the bunch prevention controller 240 are implemented as a single processor configured to operate as both the detector 230 and the bunch prevention controller 240.

A signaling device is responsible for presenting the operation instruction to the operator of the bus. For example, the signal device can visualize the time period for which the operator is to hold the bus at a station, or the extent of the bus being ahead of or behind a schedule. The signaling device can play an audio message to prompt the operator to start moving the bus along the route.

The in-vehicle controller 200 can further include a passenger information service 260. The passenger information service 260 can present minimum arrival guarantee, or next arrival estimation to a passenger on the bus. In some embodiments, the passenger information service can be implemented as a device separated from and connected to the in-vehicle controller 200.

In one embodiment, there may be a central operator module 270. The central operator module 270 can listen and receive the status data from the in-vehicle controllers. The central operator module 270 can analyze the status data and present visualized information to a central operator. Based on the visualized information, the central operator can send manual control input via the communication channel 280 to manually instruct operators of the buses along the route.

In one embodiment, an analytics engine 272 can be included in the central operator module 270. The analytics engine 272 provides a virtual schedule for buses to follow and calculate parameters to be used in the control system. In one embodiment, if desired, a human operator is able to adjust the parameters in the analytics engine or send messages manually to the operators of the vehicles. The system is capable of running automatically without manual intervention. This simplifies or eliminates the operator's task and is capable of making the high rate of pre-emptive, measured control decisions before noticeable disruptions to service can arise.

Using the techniques disclosed herein, the status information of the vehicle is distributed among the vehicles that belong to the same route. An in-vehicle controller dynamically calculates holding times at each station and displays the information to the driver so that buses do not get too close to one another, thereby preventing bunching while maintaining appropriate speeds of the vehicles.

Figure 3:
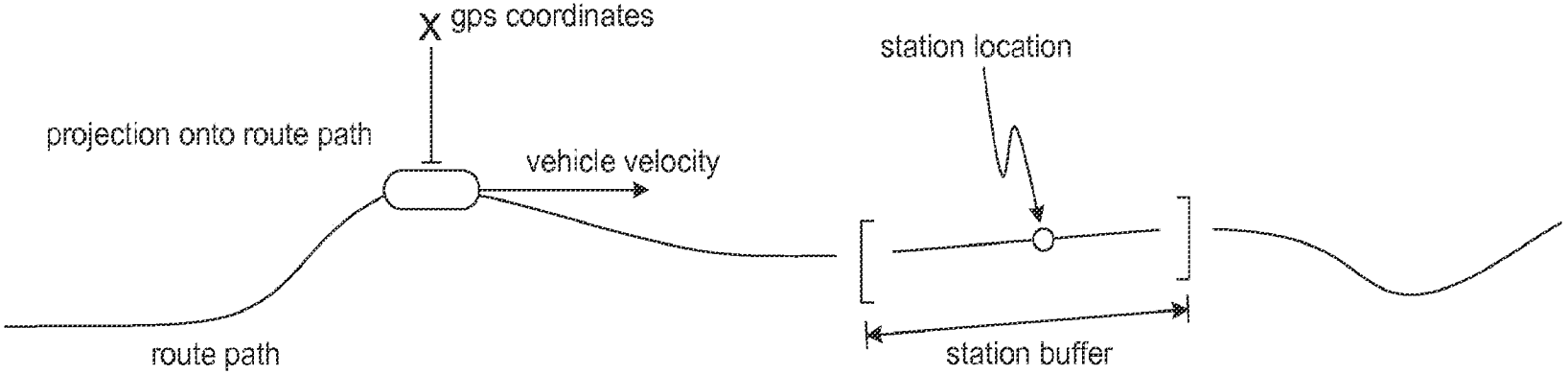
FIG. 3 illustrates relevant information for determining vehicle status.

The Information about whether the vehicle skipped the station, arrived at the station, or departed from the station, is automatically calculated based on the position and velocity information as illustrated in FIG. 3. Based on the GPS coordinates and the velocity data of the vehicle, the position and speed of the vehicle are projected onto the route path. A station buffer range is predetermined around the station location. Judging from the relative position of the vehicle from the station buffer along the route path, as well as the speed of the vehicle, the distributed transportation control system determines the vehicle status of station arrival, station departure, or station skipping.

Figure 4:
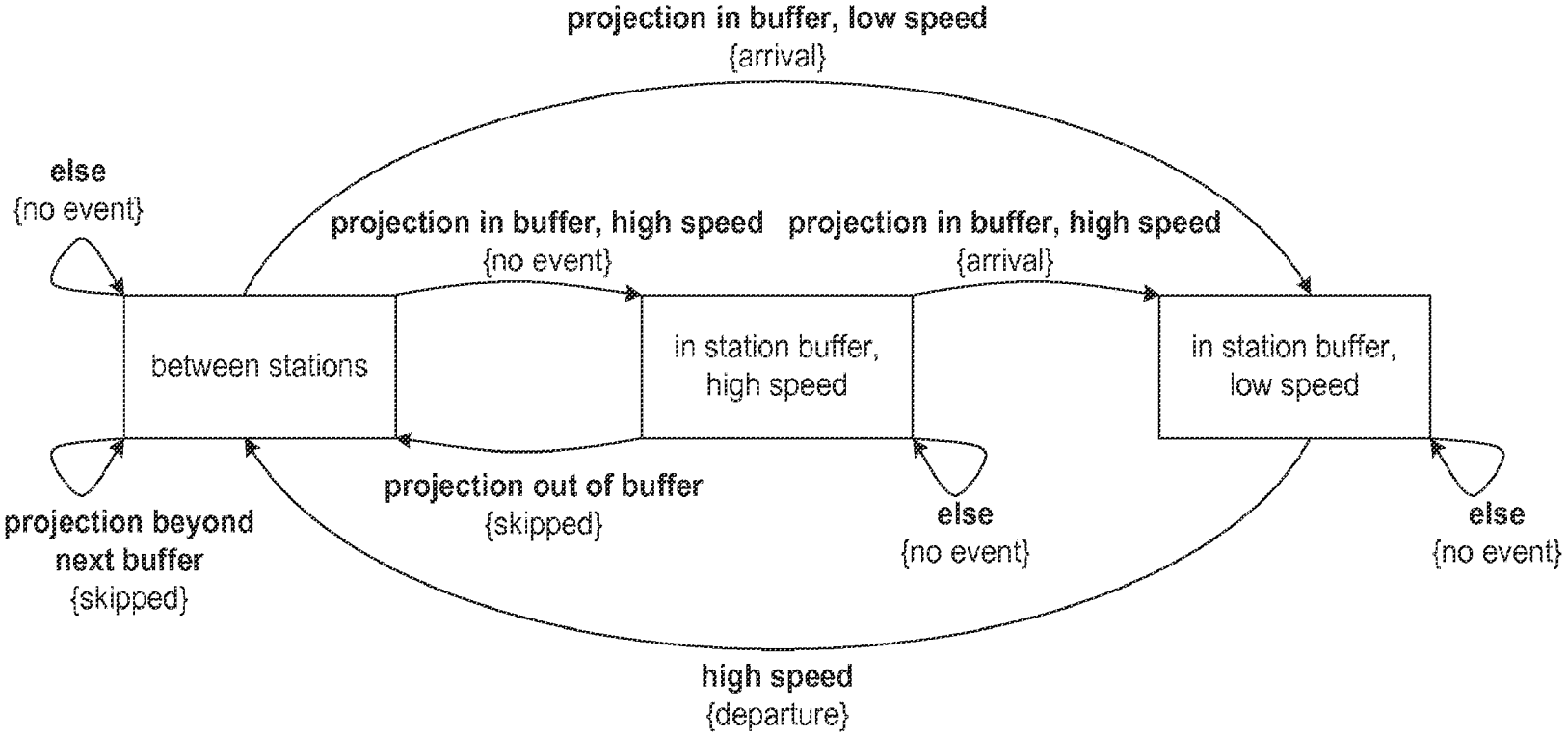
FIG. 4 illustrates an example process of determining vehicle status events.

FIG. 4 illustrates an example process of determining vehicle status events. In one embodiment, the vehicle status events include station arrivals (approaching a station); departures (leaving a station), and skips (passing through a station without stopping). The in-vehicle controller determines the status event based on the velocity of the bus and the projection of its GPS coordinates along the route. As shown in the FIG. 4, for instance, when the in-vehicle controller detects that the vehicle is between stations and the vehicle is projected to be reaching a station buffer at a low speed, the in-vehicle controller determines the status event as station arrival. When the in-vehicle controller detects that the vehicle is within a station buffer at a low speed and the vehicle changes to a high speed, the in-vehicle controller determines the status event as station departure.

Similarly, when the in-vehicle controller detects that the vehicle is within a station buffer at a high speed and the vehicle is projected in the station buffer at a high speed, the in-vehicle controller determines the status event as station arrival. When the in-vehicle controller detects that the vehicle is within a station buffer at a high speed and the vehicle is projected out of the station buffer, the in-vehicle controller determines the status event as station skipping.

In one embodiment, once the status event changes, the in-vehicle device transmits the time at which the vehicle arrived, departed or skipped a particular station, which helps limiting the amount of communication required for the system to work.

Figure 5:
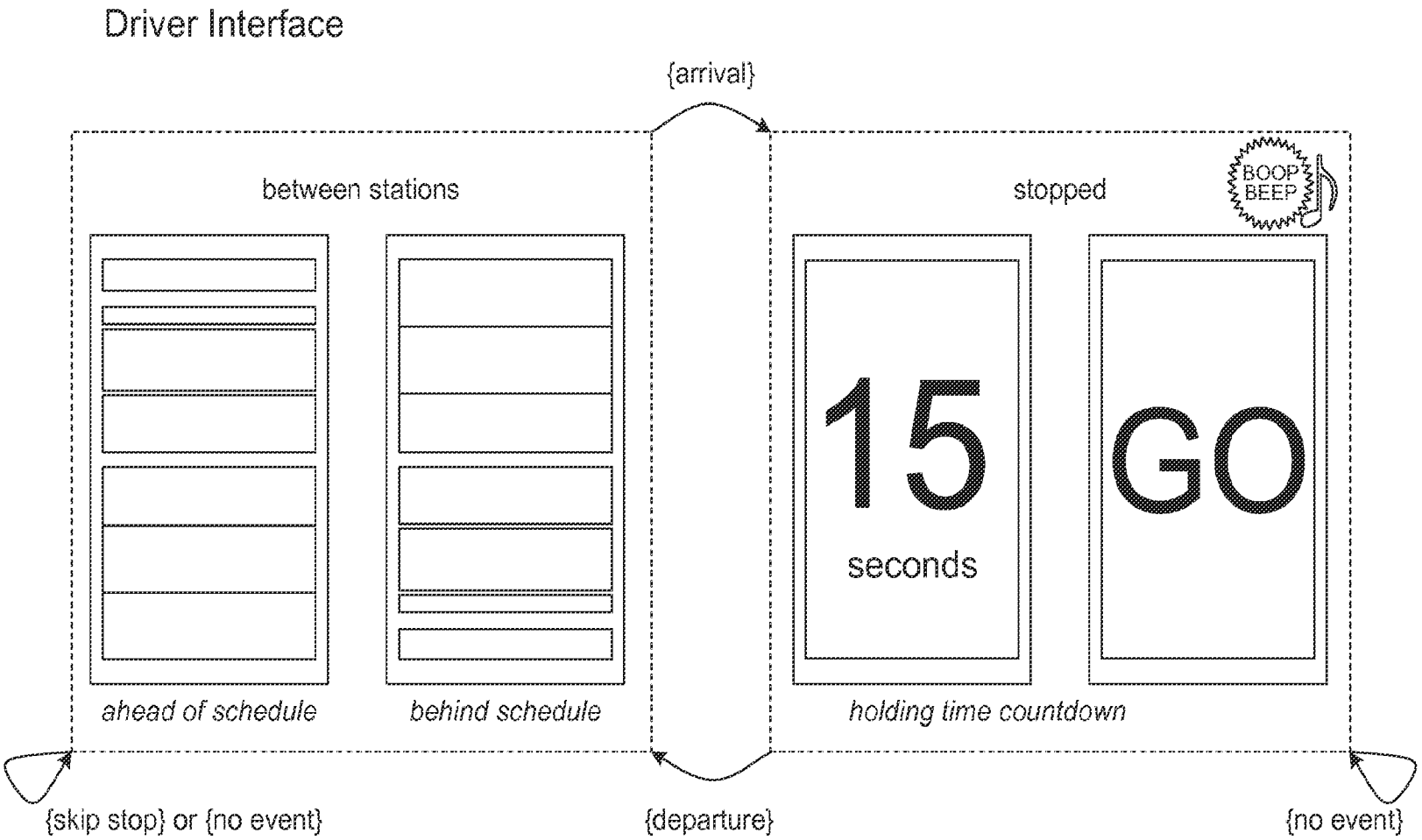
FIG. 5 illustrates an example of a vehicle operator interface of a signaling device.

FIG. 5 illustrates an example of a vehicle operator interface of a signaling device. Detection of vehicle status events allows the vehicle operator interface to switch between different display modes. In one embodiment, the operation of the vehicle operator interface does not rely on any communication with a centralized server. Between stations, a vehicle operator receives visual cues how far ahead of or behind schedule he is, so the vehicle operator can regulate the speeds of his vehicle accordingly. As shown in the FIG. 5, the vehicle operator interface visualizes a tab above a middle line to indicate the vehicle is ahead of the schedule, or a tab below the middle line to indicate the vehicle is behind the schedule. The extent that the visualized tab deviates from the middle line indicates the extent that the vehicle is ahead of or behind the schedule.

When an arrival at a station is detected, the in-vehicle controller in the vehicle calculates a holding time based on previous bus arrivals and the display will count down time until the bus is released from the station. This control information is presented to the vehicle operator through audio and visual signals as shown in FIG. 5. When the in-vehicle controller determines that the holding time lapses, it visualizes a "go" message and plays an audio message to prompt the vehicle operator to start moving the vehicle for departure.

Figure 6:
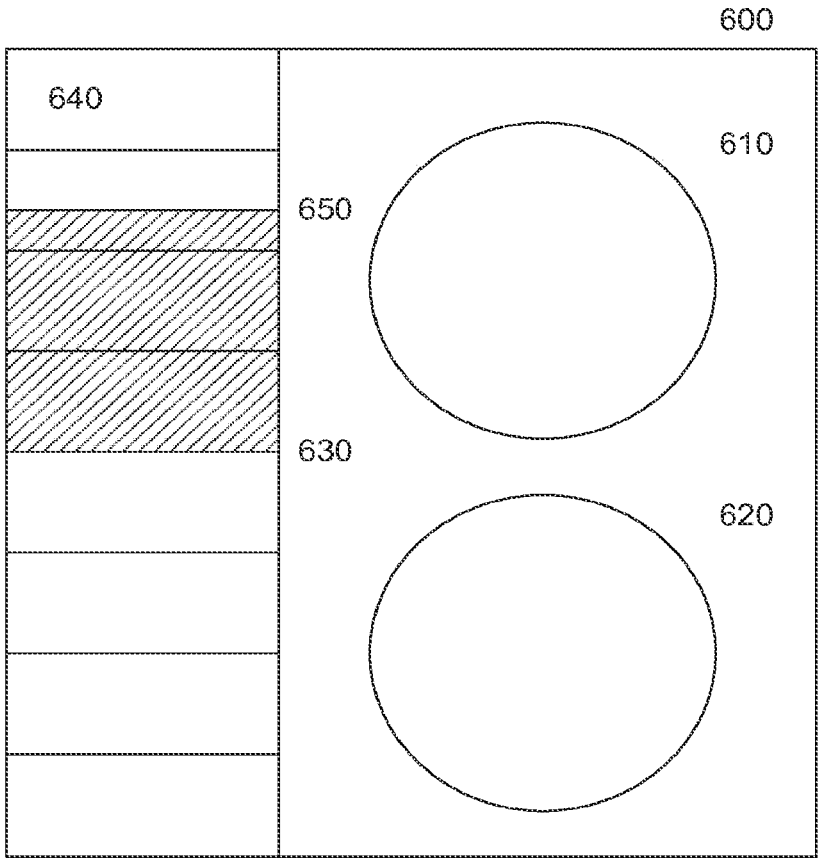
FIG. 6 illustrates another example of a vehicle operator interface of a signaling device.

FIG. 6 illustrates another example of a vehicle operator interface of a signaling device. The vehicle operator interface 600 includes a schedule bar 640 with a middle line 630. The vehicle operator interface 600 visualizes a color tab 650 above a middle line to indicate the vehicle is ahead of the schedule, or a tab below the middle line to indicate the vehicle is behind the schedule. The extent that the visualized tab deviates from the middle line indicates the extent that the vehicle is ahead of or behind the schedule. In one embodiment, the color tab 650 is filled with red color when it is above the middle line 630, and filled with green color when it is above the muddle line 630. In another embodiment, the filled color increases its brightness when the color tab 650 deviates from the middle line 630.

The upper circle 610 fills with red color when the vehicle is ahead of the schedule. In one embodiment, the color and brightness of the upper circle 610 is synchronized with the color and brightness of the color tab 650, when color tab 650 is above the middle line 630. Similarly, the lower circle 620 fills with green color when the vehicle is behind the schedule. In one embodiment, the color and brightness of the lower circle 620 is synchronized with the color and brightness of the color tab 650, when color tab 650 is below the middle line 630. The upper and lower circles filled with colors 610 and 620 make the vehicle operator easy to recognize whether he is ahead of or behind the schedule.

Figure 7:
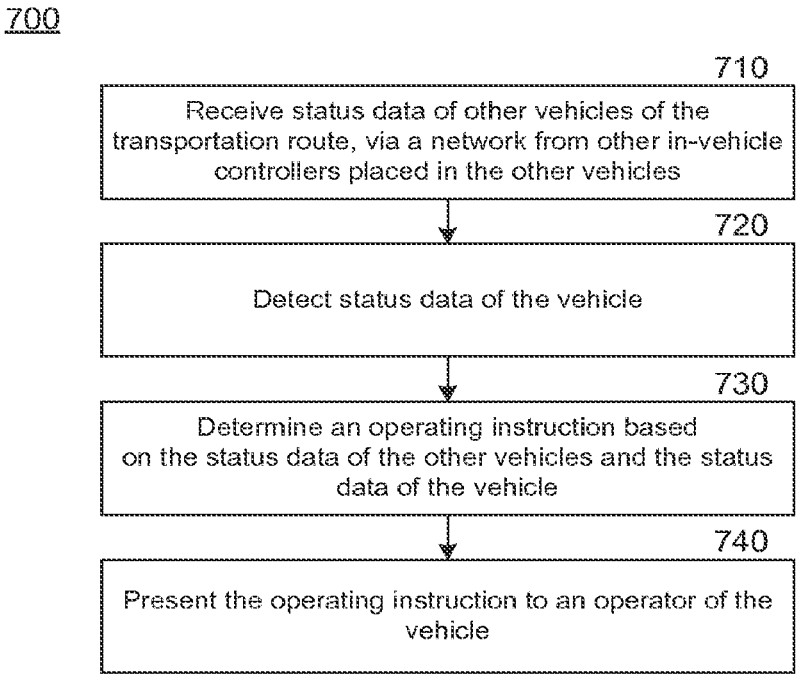
FIG. 7 illustrates an example process of scheduling a vehicle of a transportation route.

FIG. 7 illustrates an example process of scheduling a vehicle of a transportation route. At step 710, an in-vehicle controller receives status data of other vehicles of the transportation route, via a network from other in-vehicle controllers placed in the other vehicles. At step 720, the in-vehicle controller detects status data of the vehicle. At step 730, the in-vehicle controller determines an operating instruction based on the status data of the other vehicles and the status data of the vehicle. In one embodiment, the status data of the other vehicles includes position and velocity data of the other vehicles. In another embodiment, the status data of the other vehicles includes status values indicating whether the other vehicles are during station arrival, station departure, or station skipping.

At step 740, the in-vehicle controller presents the operating instruction to an operator of the vehicle. In one embodiment, the operating instruction includes a time period for which the operator is to hold the vehicle at a station, or a visual indication of an extent of the vehicle being ahead of or behind a schedule. The operating instruction can further include an audio signal to prompt the operator to move the vehicle.

In addition to controlling bus bunching, the system can be leveraged to provide additional functionality disclosed in the following paragraphs.

In one embodiment, vehicle riders can receive real-time estimates of the time until the next bus arrives at a particular stop, accessed through any internet enabled device, including cell phones, desktop web-browsers, supplementing in-vehicle information displays.

In one embodiment, additional in-vehicle devices can be positioned in the bus to display passenger relevant information such as the location of the bus, connecting lines with arrival times, landmarks and local maps.

In one embodiment, a passenger may find that even if she arrives at a station prior to the estimated arrival time, the bus has already left. There is some uncertainty with bus arrival prediction. To supplement most likely arrival estimates, the control feature enables guarantees that the next bus at a particular station will not depart earlier than a specified time. If a rider requests a guaranteed minimal arrival time, the central controller notifies the control system, instructing the driver to hold the bus at the corresponding stop, thus honoring the guarantee. It should be noted that the guarantee time is calculated so that it is very unlikely that the bus will arrive before that time; therefore the holding times required to honor guarantees will not affect overall system performance substantially.

In one embodiment, the in-vehicle computing device and automated dispatching system can be used to adjust to unexpected vehicle failures, dynamically rescheduling the route if necessary. This is different from the pre-scheduled systems, which tend to experience widespread problems stemming from local disruptions.

In one embodiment, the in-vehicle computing device and automated dispatching system can be used to synchronize transfers between intersecting routes or hierarchical "branch-trunk" systems. Buses on overlapping or intersecting lines can be made to arrive at certain hub stations in close temporal proximity. They can then be held long enough for passengers to transfer to one another, thereby guaranteeing connections.

In one embodiment, the in-vehicle computing device can be used to sense bus maintenance needs and log maintenance activities.

In one embodiment, the in-vehicle computing device can be used to quickly process passenger payments, speeding up the boarding process.

In one embodiment, the in-vehicle computing device can be used to monitor and evaluate the driving performance of bus drivers.

In one embodiment, the in-vehicle computing device and automated dispatching system can be used to dynamically schedule driver breaks at the convenience of drivers.

In one embodiment, the in-vehicle device can solicit customer feedback on the ride experience.

In one embodiment, the in-vehicle device can display real-time location-based advertising.

Figure 8:
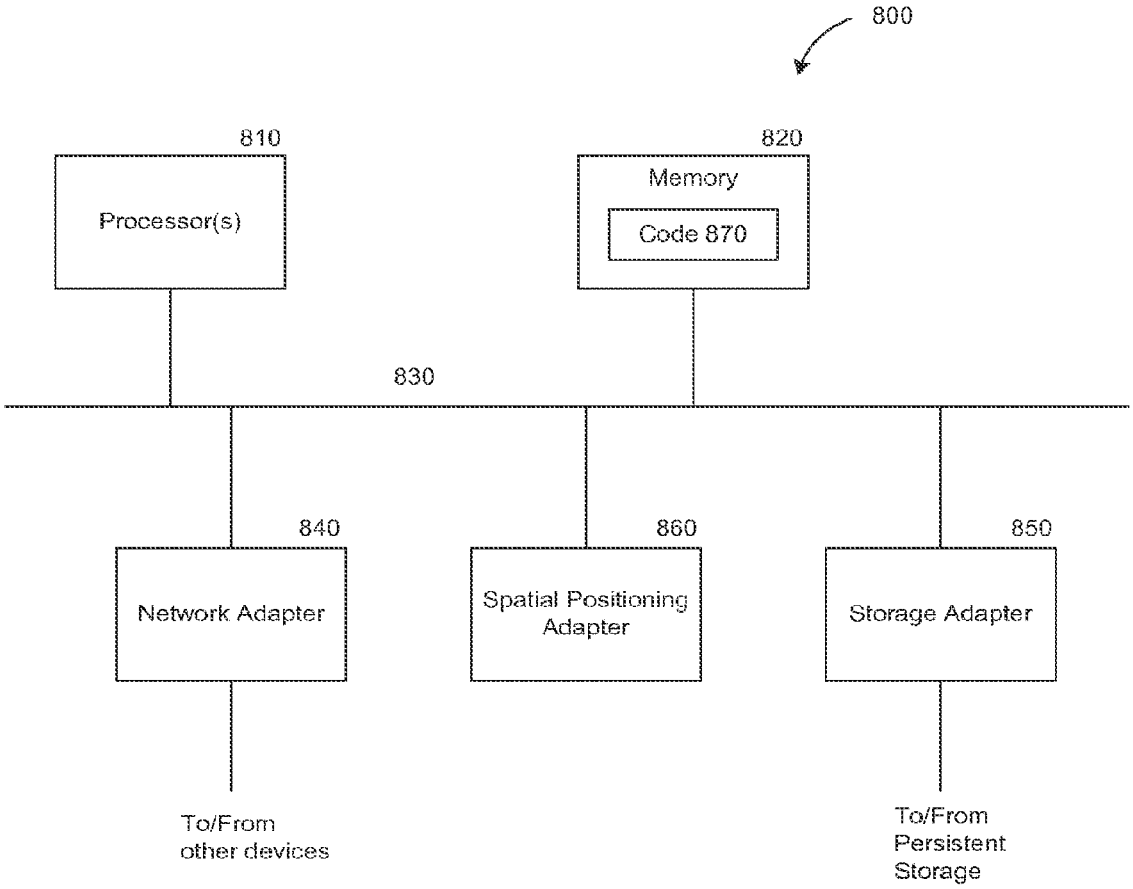
FIG. 8 is a high-level block diagram showing an example of the architecture of a device, which may represent any of the in-vehicle controllers.

FIG. 8 is a high-level block diagram showing an example of the architecture of a device 800, which may represent any of the in-vehicle controllers. The device 800 includes one or more processors 810 and memory 820 coupled to an interconnect 830. The interconnect 830 shown in FIG. 8 is an abstraction that represents any one or more separate physical buses, point to point connections, or both connected by appropriate bridges, adapters, or controllers. The interconnect 830, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire".

The processor(s) 810 is/are the central processing unit (CPU) of the storage controller 800 and, thus, control the overall operation of the device 800. In certain embodiments, the processor(s) 810 accomplish this by executing software or firmware stored in memory 820. The processor(s) 810 may be, or may include, one or more programmable general-purpose or special-purpose microprocessors, digital signal processors (DSPs), programmable controllers, application specific integrated circuits (ASICs), programmable logic devices (PLDs), trusted platform modules (TPMs), or the like, or a combination of such devices.

The memory 820 is or includes the main memory of the device 800. The memory 820 represents any form of random access memory (RAM), read-only memory (ROM), flash memory, or the like, or a combination of such devices. In use, the memory 820 may contain, among other things, code 870 embodying at least a portion of an operating system of the device 800. Code 870 may also include instructions for executing the techniques disclosed herein.

Also connected to the processor(s) 810 through the interconnect 830 are a network adapter 840 and a storage adapter 850. The network adapter 840 provides the device 800 with the ability to communicate with devices, such as other in-vehicle controllers, over a network and may be, for example, an Ethernet adapter or Fibre Channel adapter. In some embodiments, a device may use more than one network adapter to deal with the communications within and outside of the data storage cluster separately. The storage adapter 850 allows the device 800 to access a persistent storage, and may be, for example, a Fibre Channel adapter or SCSI adapter. Device 800 can further includes a spatial positioning adapter 860 for collecting spatial navigation data.

The code 870 stored in memory 820 may be implemented as software and/or firmware to program the processor(s) 810 to carry out actions described below. In certain embodiments, such software or firmware may be initially provided to the device 800 by downloading it from a system through the device 800 (e.g., via network adapter 840).

The techniques introduced herein can be implemented by, for example, programmable circuitry (e.g., one or more microprocessors) programmed with software and/or firmware, or entirely in special-purpose hardwired circuitry, or in a combination of such forms. Special-purpose hardwired circuitry may be in the form of, for example, one or more application-specific integrated circuits (ASICs), programmable logic devices (PLDs), field-programmable gate arrays (FPGAs), etc.

Software or firmware for use in implementing the techniques introduced here may be stored on a machine-readable storage medium and may be executed by one or more general-purpose or special-purpose programmable microprocessors. A "machine-readable storage medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible storage medium includes recordable/non-recordable media (e.g., read-only memory (ROM); random access memory (RAM); magnetic disk storage media; optical storage media; flash memory devices; etc.), etc.

The term "logic", as used herein, can include, for example, programmable circuitry programmed with specific software and/or firmware, special-purpose hardwired circuitry, or a combination thereof.

In addition to the above mentioned examples, various other modifications and alterations of the invention may be made without departing from the invention. Accordingly, the above disclosure is not to be considered as limiting and the appended claims are to be interpreted as encompassing the true spirit and the entire scope of the invention.

What is claimed is:

1. An in-bus controller installed in a bus comprising:

a network interface configured to receive status data of other busses of a transportation route, via a network from other in-bus controllers placed in the other busses;

a spatial positioning device configured to continuously collect status data of the bus in which the in-bus controller is placed;

a signaling device configured to provide an operating instruction to a bus driver of the bus in which the in-bus controller is placed;

a processor configured to determine the operating instruction based on the status data of the busses; and a passenger display configured to display passenger information, passenger information including a location of the bus, connecting transportation lines with arrival times, landmarks, local maps, or real-time location-based advertisements.

2. The in-bus controller of claim 1, wherein the operating instruction includes a time period for which the bus driver is to hold the bus at a station, or a visual indication of an extent of the bus being ahead of or behind a schedule.

3. The in-bus controller of claim 2, wherein the time period is determined such that the bus will not leave a station before a guaranteed time.

4. The in-bus controller of claim 1, wherein the processor is further configured to determine a real-time estimate of a time until a next bus arrives at a station.

5. The in bus controller of claim 1, wherein the network interface is further configured to receive status data from busses from a second route, and the processor is further configured to determine the operation instruction such that the bus at which the in-bus controller is placed and a second bus from the second route arrive at a hub station in a predetermined temporal proximity.

6. The in-bus controller of claim 1, wherein the processor is further configured to dynamically generate a new bus schedule based on the status data of the busses.

7. The in-bus controller of claim 1, wherein the processor is further configured to determine maintenance needs of the bus or to record maintenance activities of the bus.

8. The in-bus controller of claim 1, further comprising:

a payment module configured to process passenger payments.

9. The in-bus controller of claim 1, further comprising:

a monitoring module configured to monitor driving performance of the bus driver.

10. The in-bus controller of claim 1, wherein the processor is further configured to dynamically determine bus driver break schedule.

11. The in-bus controller of claim 1, further comprising:

a feedback module configured to collect passenger feedback on ride experience.

12. The in-bus controller of claim 1, wherein the spatial position device is a satellite navigation device.

13. An in-vehicle controller in a mass-transit vehicle comprising:

a network interface configured to receive status data of other mass-transit vehicles of a transportation route, via a network from other in-vehicle controllers placed in the other mass-transit vehicles;

a spatial positioning device configured to continuously collect status data of the mass-transit vehicle in which the in-vehicle controller is placed;

a signaling device configured to provide an operating instruction to an operator of the mass-transit vehicle in which the in-vehicle controller is placed, wherein the processor is further configured to determine maintenance needs of the mass-transit vehicle or to record maintenance activities of the mass-transit vehicle.

14. An in-vehicle controller in a mass-transit vehicle comprising:

a network interface configured to receive status data of other mass-transit vehicles of a transportation route, via a network from other mass-transit in-vehicle controllers placed in the other mass-transit vehicles;

a spatial positioning device configured to continuously collect status data of the mass-transit vehicle in which the in-vehicle controller is placed;

a signaling device configured to provide an operating instruction to an operator of the mass-transit vehicle in which the in-vehicle controller is placed; and a payment module configured to process passenger payments.

15. An in-vehicle controller in a mass-transit vehicle comprising:

a network interface configured to receive status data of other mass-transit vehicles of a transportation route, via a network from other in-vehicle controllers placed in the other mass-transit vehicles;

a spatial positioning device configured to continuously collect status data of the mass-transit vehicle in which the in-vehicle controller is placed;

a signaling device configured to provide an operating instruction to an operator of the mass-transit vehicle in which the in-vehicle controller is placed; and a feedback module configured to collect passenger feedback on ride experience.

* * * * *